United States Patent [19]

Ginter et al.

[11] Patent Number: 4,907,673

[45] Date of Patent: Mar. 13, 1990

[54] STERN PLATFORM LADDER

[75] Inventors: L. James Ginter; K. Thomas Kurz, both of Green Bay, Wis.

[73] Assignee: Cruisers, Incorporated, Oconto, Wis.

[21] Appl. No.: 378,644

[22] Filed: Jul. 12, 1989

[51] Int. Cl.[4] ..... B63B 29/20; E06C 5/04

[52] U.S. Cl. ..... 182/81; 182/84; 114/362

[58] Field of Search ..... 189/78, 81, 84, 77, 189/86; 114/362

[56] References Cited

U.S. PATENT DOCUMENTS

| | | | |
|---|---|---|---|
| 78,152 | 5/1868 | Steger | 182/81 |
| 321,638 | 7/1885 | Ralph | 182/81 |
| 505,465 | 9/1893 | Hughes | 182/81 |
| 826,884 | 7/1906 | Reynolds | 182/81 |
| 2,558,975 | 7/1951 | Moreno et al. . | |
| 3,052,896 | 9/1962 | Beach | 114/362 |
| 4,669,414 | 6/1987 | Molino | 114/362 |
| 4,712,503 | 12/1987 | Ritten | 114/362 |
| 4,722,419 | 2/1988 | Hoszowski . | |
| 4,724,925 | 2/1988 | Ritten . | |
| 4,726,317 | 2/1988 | Ritten et al. . | |
| 4,733,752 | 3/1988 | Sklar . | |
| 4,735,285 | 4/1988 | Ritten . | |
| 4,742,795 | 5/1988 | DePrey et al. . | |
| 4,823,910 | 4/1989 | Day | 182/84 |

FOREIGN PATENT DOCUMENTS

| | | |
|---|---|---|
| 2438578 | 6/1980 | France . |

*Primary Examiner*—Reinaldo P. Machado
*Attorney, Agent, or Firm*—Quarles & Brady

[57] ABSTRACT

A foldable ladder for use with a swim platform of a boat is disclosed. A hinged panel adapted to fit in an opening in the swim platform pivots between a closed position and an open position. An upper ladder portion, which includes handrails, is fixed to the underside of the panel and pivots with the panel. A lower ladder portion, which includes a rung, is pivotally connected to the upper ladder portion. A control link is pivotally connected at one end to the boat and at the other end to the lower ladder portion. Raising the panel automatically deploys the ladder and closing the panel automatically stows the ladder beneath the panel.

7 Claims, 4 Drawing Sheets

STERN PLATFORM LADDER

BACKGROUND OF THE INVENTION

The present invention relates to ladders for use with swim platforms that are attached to the transom of a boat. More particularly, it pertains to a foldable ladder that is connected to a hinged panel in the swim platform, so that raising the panel automatically deploys the ladder and closing the panel automatically stows the ladder.

Modern pleasure boats are frequently designed with swim platforms that are connected to the transom of the boat. The platforms are normally located slightly above the waterline and may incorporate a ladder to permit boarding from the water. Ladders that attach to the swim platform have been mounted on either the top side or the underside of the platform.

Ladders that mount on the top side of the platform commonly have a fixed portion that remains on the top of the platform. Other portions of the ladder are then pivoted or slid between a stow position (on top of the platform) and a deployed position (below the platform). In the stowed position, persons walking on the platform must avoid both the fixed and the movable portions of the ladder. The deployed ladder position may also be inconvenient because some designs require that a person reach beneath the level of the swim platform in order to retrieve the movable portions of the ladder. Furthermore, ladders mounted on the top side of the platform tend to be unsightly. The visual presence of the ladder when it is stowed detracts from the streamline look of the swim platform and stern of the boat.

Ladders that mount on the underside of the platform also move between stowed and deployed positions. Adjustments of the ladder between the positions can be difficult, however, because a person must reach beneath the platform to adjust the ladder. Also, in many ladder designs, the ladder when deployed does not extend above the level of the swim platform, which can make reboarding the boat via the ladder difficult.

Thus, it can be seen that an improved ladder is needed which can be easily deployed and stowed, and will contribute to the overall streamlined appearance of the boat.

SUMMARY OF THE INVENTION

This invention provides a swim platform ladder for a boat. The ladder includes a panel that is adapted to fit in an opening in a swim platform of the boat. The panel has a top side and an underside. The ladder also includes a first hinge for mounting the panel to the boat. Due to the first hinge, the panel can pivot about a horizontal axis between a closed position and an open position. In the closed position, the panel is generally horizontal and in the plane of the swim platform. In the open position, though, the panel is generally vertical and above the plane of the swim platform. An upper ladder portion is fixed to the underside of the panel. Thus, the upper ladder portion pivots with the platform about the axis of the first hinge. The upper ladder portion has hand rails that extend above the swim platform when the panel is in the open position. A lower ladder portion, which is below the upper ladder portion when the panel is in the open position, has at least one rung. A second hinge provides a joint between the upper and the lower ladder portions. The joint allows the portions to pivot relative to one another about a horizontal axis parallel to the axis of the first hinge. The ladder also includes at least one control link having two ends, and a third hinge for pivotally connecting one end of each control link to the boat. The third hinge allows the control link to rotate about a horizontal axis parallel to the axis of the first hinge. A fourth hinge pivotally connects the other end of each control link to the lower ladder portion for rotation about a horizontal axis parallel to the axis of the first hinge. Thus, this aspect of the invention advantageously mounts the ladder on the underside of a panel that fits within an opening in a swim platform. The ladder is conveniently out of the way for persons walking on the platform, and the ladder when stowed gives the boat an attractive, streamlined look.

In another aspect, moving the panel into the open position deploys the ladder so that it extends downwardly beneath the platform. Conversely, moving the panel into the closed position folds the ladder to stow it under the panel. This aspect of the invention provides a ladder which is conducive to ease of operation.

Thus, it is an object of the present invention to provide a swim platform ladder for a boat that is mounted on the under side of a panel to give a streamlined appearance to the boat.

It is another object of the invention to provide a ladder that can be deployed and stowed in response to the movement of a panel to which the ladder is attached.

It is another object of the invention to provide a ladder for use with a swim platform where the ladder is conveniently out of the way of persons walking on the platform.

It is still another object of the invention to provide a swim platform ladder that extends above the level of the platform when the ladder is deployed, so that boarding the boat from the water is made easier.

The foregoing and other objects and advantages of the invention will be evident from the following description. In the description, reference is made to the accompanying drawings which form a part hereof, and in which there is shown by way of illustration preferred embodiments of the invention such embodiments do not necessarily represent the full scope of the invention. Reference is therefore made to the claims herein for interpreting the scope of the invention.

DETAILED DESCRIPTION OF THE PREFERRED EMBODIMENT

Figure 1:
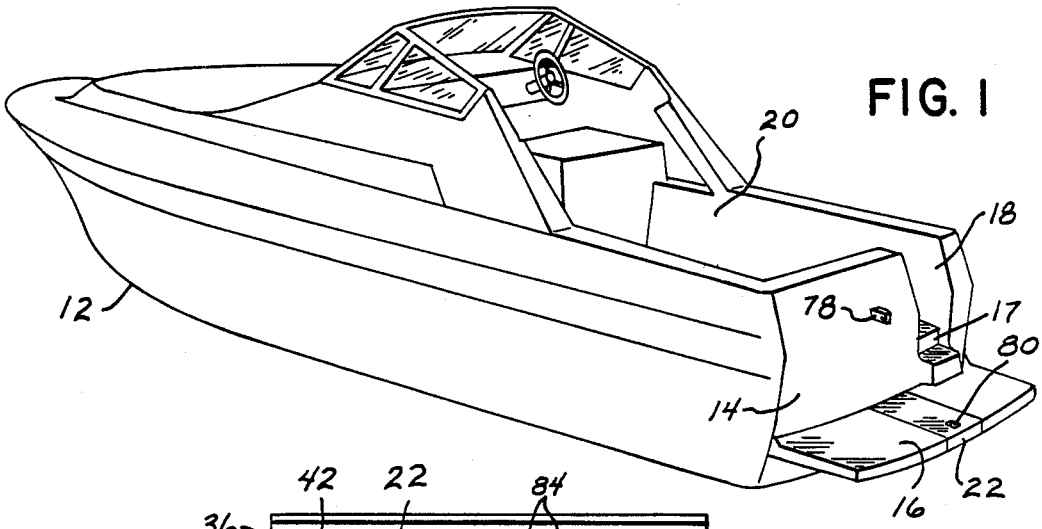
FIG. 1 is a rear perspective view of a boat incorporating a stern platform ladder according to the present invention, with the ladder in a stowed position.

Referring to FIG. 1, a boat 12 has a transom 14 located at the stern. A swim platform 16 is shown as being molded integrally with the transom 14, but may also be formed separately and attached to the transom 14. Stairs 17 and an entranceway 18 allow passengers to easily pass between a cockpit area 20 and the swim platform 16. According to the invention, the platform 16 is formed with an opening in which a panel 22 is positioned. The opening in the platform 16 is shown as being defined on three sides by the platform 16 and transom 14. The opening could also be located at an interior location of the platform 16 so that the opening would be closed on all sides by the platform 16 and transom 14. Note that the panel 22 is shown in a closed or stowed position (substantially coplanar with the swim platform 16) in FIG. 1.

Figure 2:
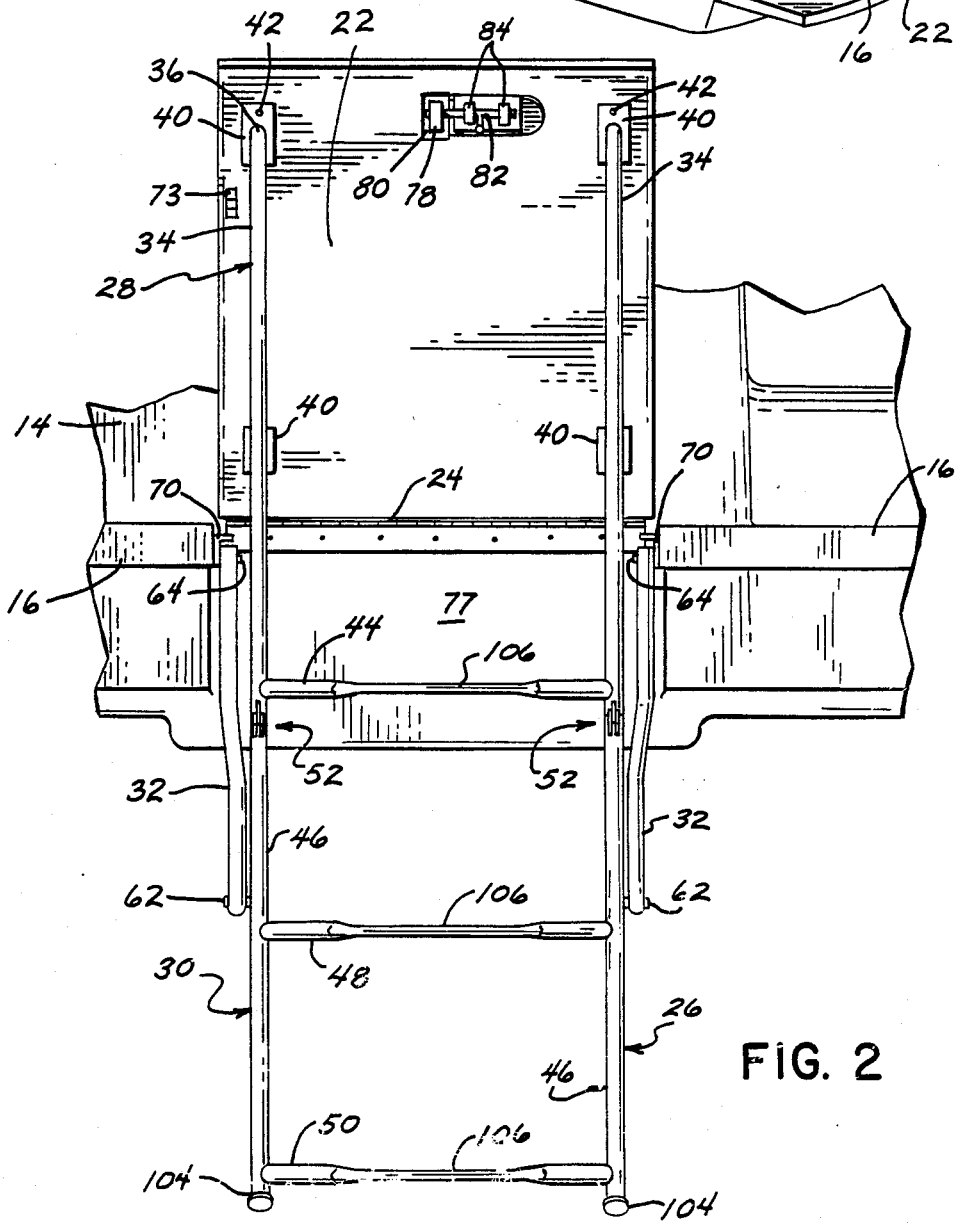
FIG. 2 is an enlarged end plan view of the boat of FIG. 1, but showing the ladder in a deployed position.
Figure 3:
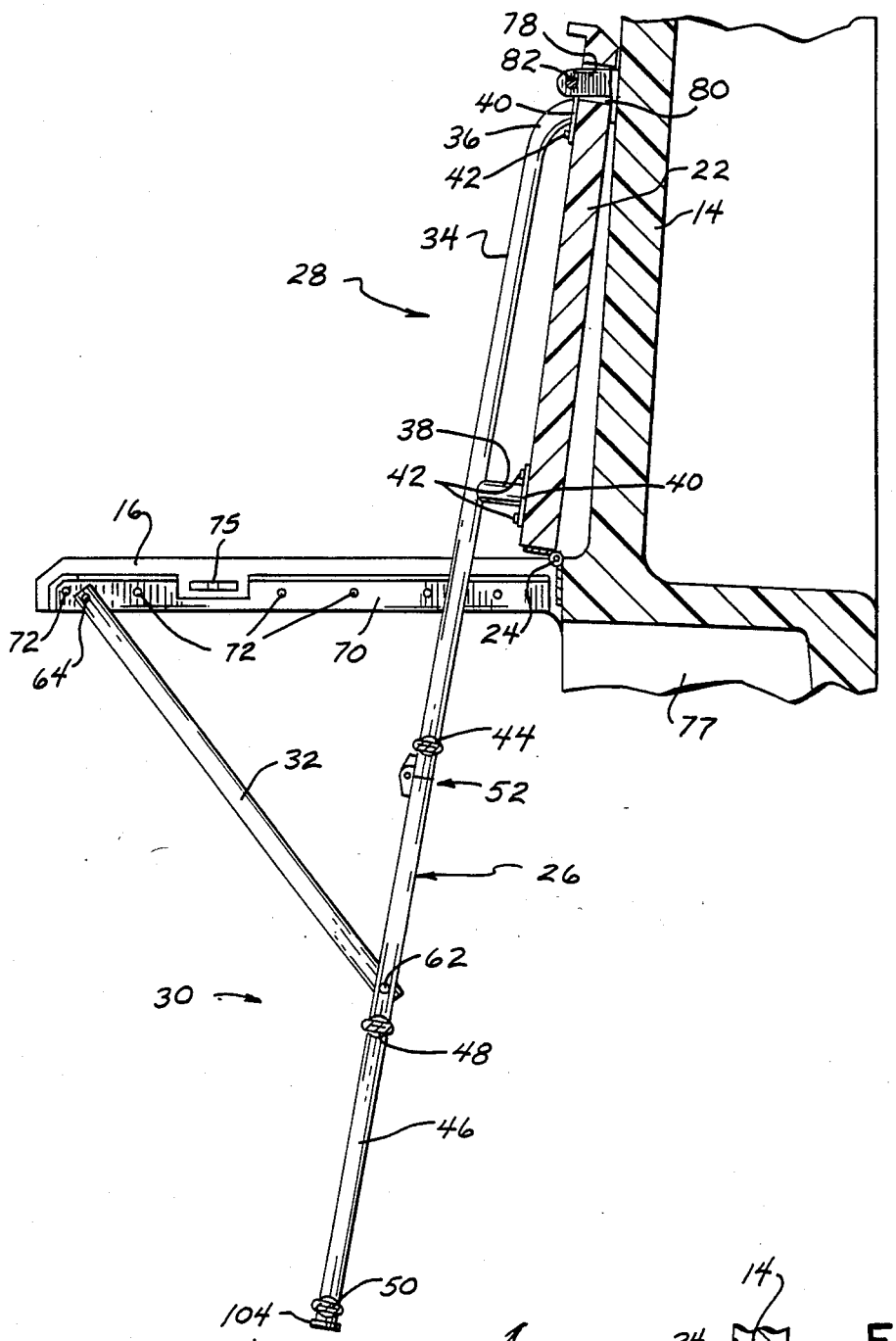
FIG. 3 is a view in vertical section of the lader shown in FIG. 2.

In FIGS. 2 and 3, the panel 22 is shown in an open or deployed position. A horizontal piano hinge 24 forms the joint between the panel 22 and the transom 14 to allow the panel 22 to pivot between its open and closed positions about the hinge axis. The panel 22 is shown in a form that is designed to be opened and closed manually, but could also incorporate a motor device (not shown) to automatically operate the panel 22. As shown in FIG. 2, a folding ladder 26 is attached to the underside of the panel 22.

The ladder 26 is constructed generally of an upper ladder portion 28, a lower ladder portion 30, and a pair of control links 32. The upper portion 28 includes a pair of spaced-apart hand rails 34. Each hand rail 34 has a curved end 36 and a support leg 38(FIGS. 3 and 4) welded to the hand rail 34. Brackets 40 are welded to the curved ends 36 and support legs 38. To fasten the upper portion 28 to the panel 22, screws 42 are inserted into holes in the brackets 40 and fastened to the panel 22. The panel 22 may be any suitably rigid material, e.g., fiberglass, wood, aluminum, or a wood/fiberglass composite. The ladder 26 would typically be a metal such as aluminum or stainless steel. A first rung 44 of the ladder 26 is welded at opposite ends to the hand rails 34. Thus, the upper portion 28 of the ladder 26 is fixed to the underside of the panel 22 and therefore pivots about the axis of the hinge 24 with the panel 22.

Figure 9:
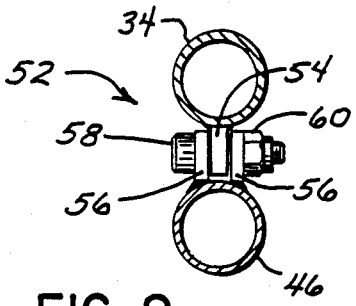
FIG. 9 is a sectional view taken from the plane of the line 9—9 of FIG. 8.
Figure 8:
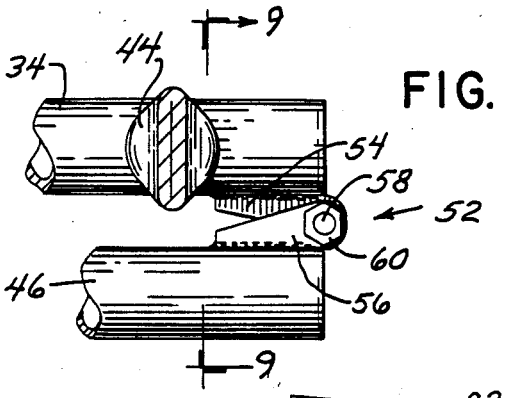
FIG. 8 is an enlarged view of a hinge joint between components of the ladder.

The lower portion 30 of the ladder 26 includes a pair of side bars 46 that are spaced apart by and welded to a second rung 48 and a third rung 50. The lower portion 30 is connected to the upper portion 28 at joints 52. As shown in greater detail in FIGS. 8 and 9, each joint 52 is formed by the handrails 34 having a lip 54 welded on and the side bars 46 having a pair of walls 56 welded on that are adapted to receive the lip 54 between them. A bolt 58 extends through apertures (not shown) in the walls 56 and lip 54 and into a nut 60, thereby creating a pivotable connection between each handrail 34 and the corresponding side bar 46. Note that the joint 52 between the port side handrail and side bar is shown in FIGS. 8 and 9, but that the joint 52 between the starboard side handrail and side bar is constructed similarly.

Figure 4:
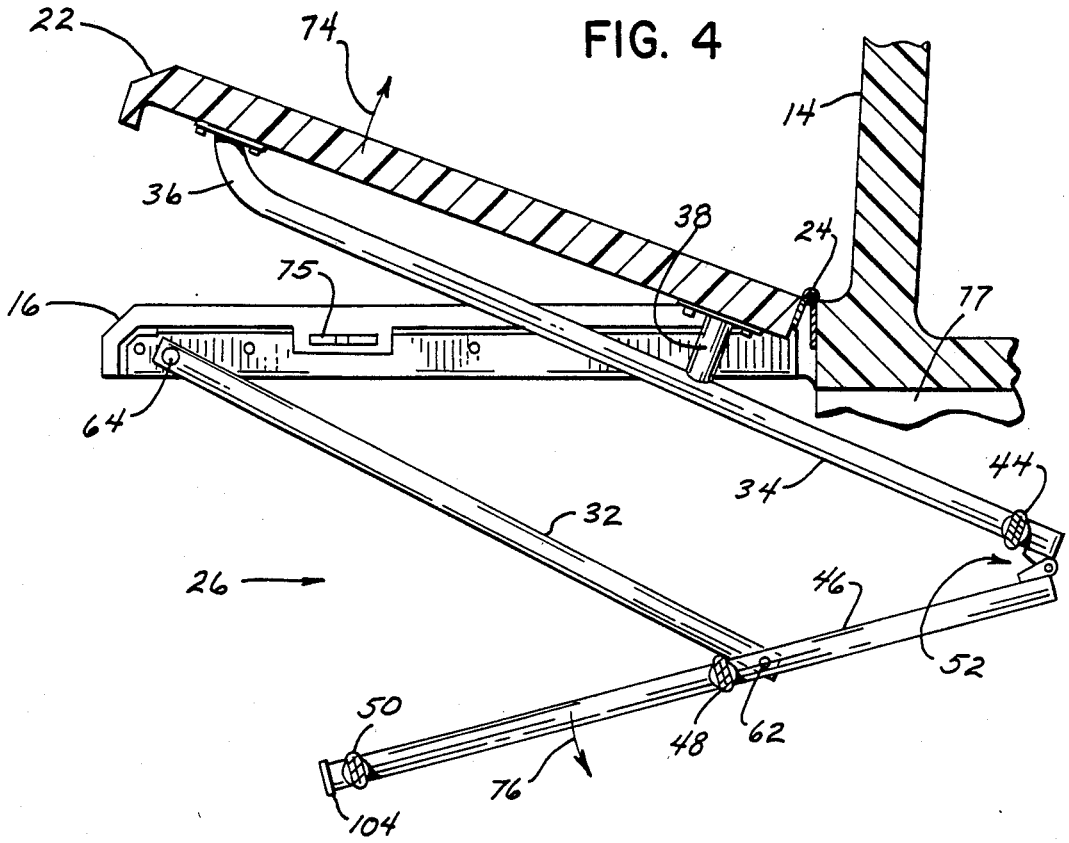
FIG. 4 is a view in vertical section similar to the view in FIG. 3, but showing the ladder in a partially deployed position.
Figure 7:
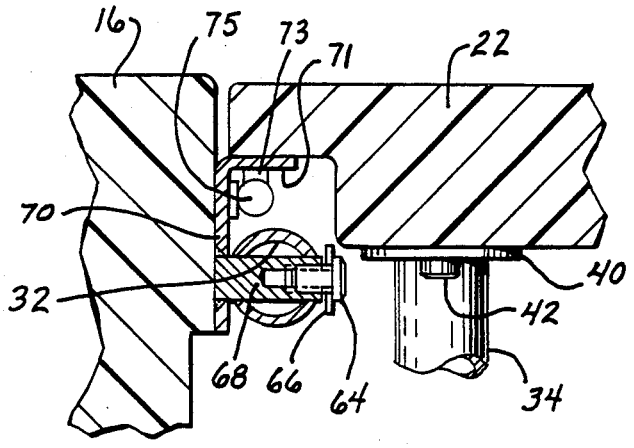
FIG. 7 is an enlarged sectional view of a connection between the platform and the ladder.

The pair of control links 32 are each pivotably connected between the side bars 46 and the swim platform 16. One end of each control link 32 is connected to a side bar 46 by a pin 62. The pin 62 is transverse to the side bar 46 and permits the control link 32 to rotate about an axis passing through the pin 62 (parallel to the ladder rungs). At the opposite, upper, end of each control link 32, the link 32 is pivotably connected to the swim platform 22 by screw 64. Viewing FIG. 7 which shows this connection in greater detail (panel 22 is in closed position), the screw 64 passes through washer 66 and fastens to a plug 68. The plug 68 is fastened such as by welding to a mounting plate 70 that is secured to the swim platform 16 by screws 72 (FIGS. 3 and 4). The plug 68 fits within an aperture in the control link 32 to permit the link to rotate about an axis passing longitudinally through the screw 64 and the plug 68 (parallel to the ladder rungs).

With both ends of each control link 32 pivotally mounted, the control link 32 is limited in its movement. The longitudinal axes of the pin 62 and the plug 68 are parallel, however, thus permitting the link 32 to rotate about plug 68 when the position of the panel 22 is changed.

Each control link 32 is tubular with a slight bend (compare FIGS. 2-5). As best seen in FIG. 2, the bend in the control link 32 allows the opening in the platform 16 to be larger than the width (distance between hand rails 34) of the ladder 26. A larger opening may be desirable to provide sufficient space for people to climb the ladder 26.

Figure 6:
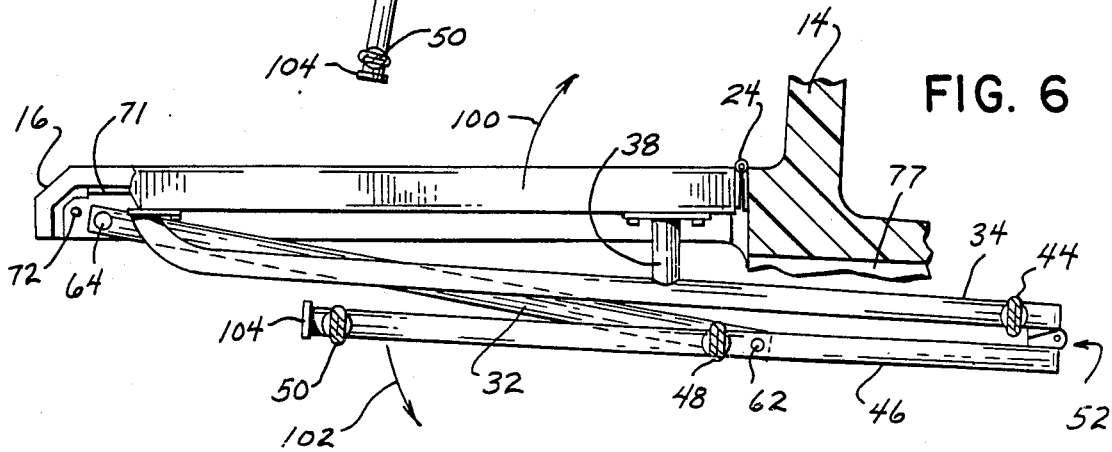
FIG. 6 is a view in vertical section of the ladder in the stowed position shown in FIG. 5, with a portion broken away.
Figure 5:
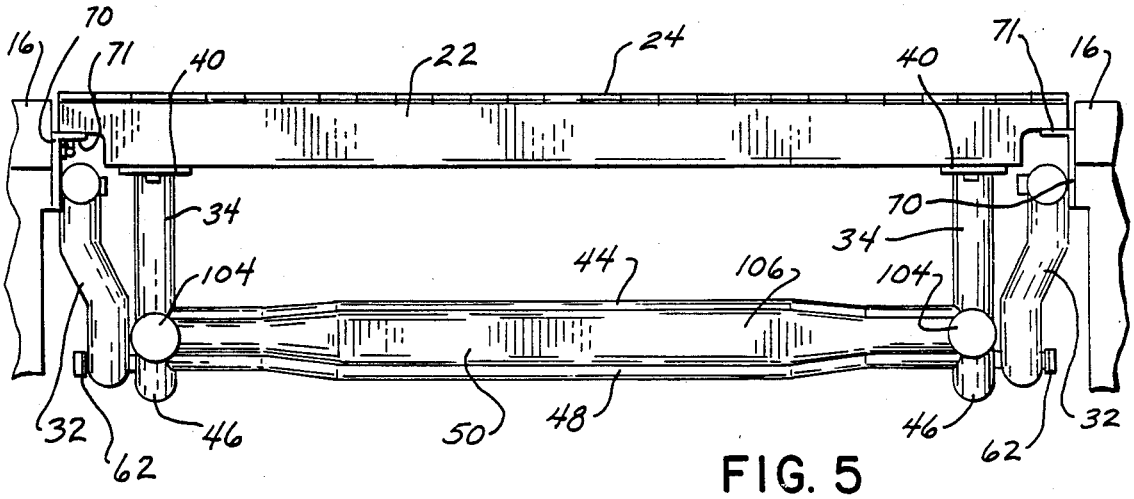
FIG. 5 is an enlarged rear end plan view of the boat of FIG. 1 showing the ladder stowed.

Operation of the lader 26 may best be understood by reference to FIG. 4. The panel 22 is shown in an intermediate position between being fully open (FIGS. 2 and 3) and fully closed (FIGS. 1, 5 and 6). Movement of the panel 22 controls the ladder 26. Hence, the ladder 26 in FIG. 4 is not fully deployed (FIGS. 2 and 3) or fully stowed (FIGS. 1, 5 and 6). By manually lifting the aft portion of panel 22, the panel pivots about hinge 24 and moves in the direction of arrow 74. Handrail 34, being rigidly fixed to the underside of the panel 22, is caused to move in a similar manner. The side bar 46 and the control link 32 respond to movement of the panel 22 and handrail 34. The joint 52 and pivotal connections at pin 62 and plug 68 cause side bar 46 to move in the direction of arrow 76 when the panel 22 is raised in the direction of arrow 74. Movement will continue in the directions of arrows 74 and 76 until the panel 22 is fully open and the ladder 26 is fully deployed, as in FIGS. 2 and 3.

Referring to FIGS. 2 and 3, it can be seen that the hand rails 34 extend beneath the level of the platform 16 when the panel 22 is open. As the panel 22 is moved from the open position into the closed position, the hand rail 34 rotates about the hinge 24. The part of the hand rail 34 adjacent the joint 52 is caused to move forward. Thus, when the panel 22 and hinge 24 are located adjacent the transom 14, as shown in the drawings, the hull of the boat 12 can be formed with a cut-away portion 77 (Figs.2, 3, 4 and 6) to house the front part of the hand rails 34 in the stowed position.

The position of the lower portion 30 of the ladder 26 is guided by the control links 32. Absent the control links 32, the side bars 46 would hang and freely pivot from joint 52. The control links 32, however, guide the lower portion 30 into a stowed position (FIGS. 5 and 6) when the panel 22 is closed. As the panel 22 is closed, the position of joint 52 is moved forward. The control links 32 limit forward movement of the side bars 46, and draw the lower ladder portion 30 into the stowed position. The ladder 26 will function properly with a single control link 32, although the pair of control links 32 provide extra stability for the ladder 26.

As shown in FIGS. 5 and 6, when the panel 22 is fully closed, the ladder 26 is in a stowed position beneath the panel 22 and platform 16. The panel 22 rests on flange 71 (FIGS. 5 and 7) of mounting plate 70 when closed. The weight of the panel 22 should be sufficient to keep the ladder 26 stowed. A locking device such as a detent having male and female members 73 and 75 (FIGS. 2-5 and 7) along the side edge of the panel 22, however, aids in keeping the panel 22 closed, and therefore the ladder 26 stowed. The male member 73 (FIGS. 2 and 7) is fastened to the under side of the panel 22, and the female member 75 (FIGS. 3, 4 and 7) is fastened to the platform 16 at a corresponding location, where the mounting plate 70 is partially cut away. Also, even if the ladder 26 were to bounce open while the boat was under way in the normal, forward direction, the lower portion 30 of the ladder 26 adjacent the bottom rung 50 would enter the water first. Given the angle of the lower portion 30 of the ladder 26, the force and buoyancy of the water moving past the ladder would tend to force the ladder back into the stowed position.

To deploy the ladder 26 from the stowed position, one need only manually lift panel 22 in the direction of arrow 100 of FIG. 6 Panel 22 and the upper ladder portion 28 will rotate about hinge 24, and the position of joint 52 will move aftward. The lower ladder portion 30 will move in the direction of arrow 102 (FIG. 6), as guided by the control links 32. Note that when the ladder 26 is fully deployed, the hand rails 34 are substantially aligned with the side bars 46 (see FIGS. 2 and 3) with their adjacent ends abutting to give the ladder 26 additional resistance against the lower portion pivoting counterclockwise (as viewed in FIG. 3) relative to the upper portion 28.

In the open position (FIGS. 2 and 3), the panel 22 should be locked in place to secure the ladder in the deployed position. A stem 78 (FIGS. 1-3) projects outward from the transom 14. Correspondingly, an aperture 80 in the panel 22 is designed to receive the stem 78 when the panel 22 is open. A dead bolt type latch 82 that slides within guides 84 is mounted on the underside of the panel 22. When the panel 22 is open (FIGS. 2 and 3), the latch 82 may be slid to engage a hole in the stem 78 and lock the panel in the fully raised (open) position. In this way, the ladder 26 is locked in the deployed position and will not fold into the deployed position under the weight of a person using the ladder.

Figure 11:
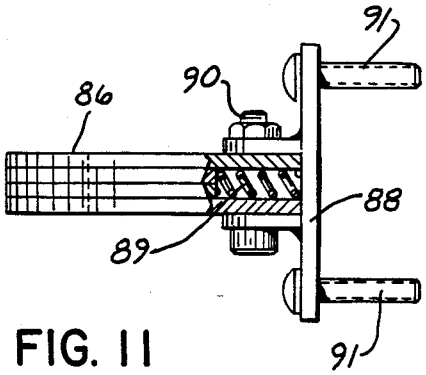
FIG. 11 is a top view of the lock mechanism shown in FIG. 10 with a portion broken away.
Figure 10:
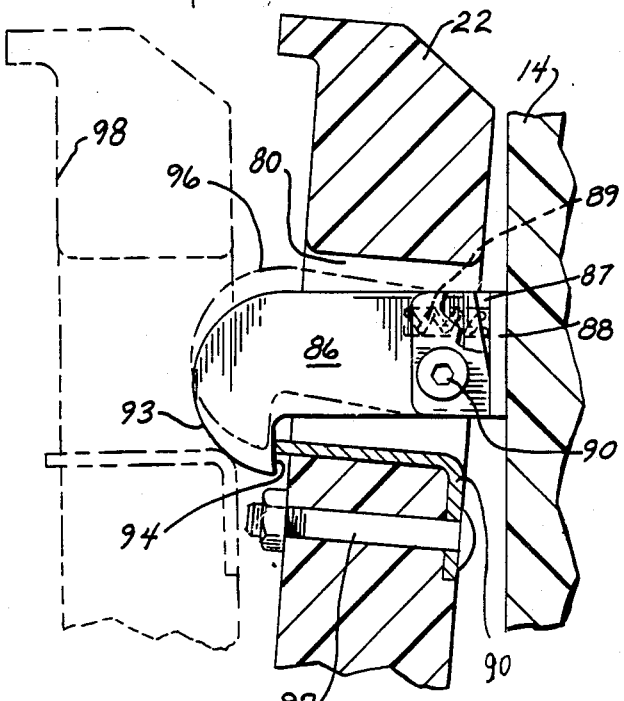
FIG. 10 is a side view of a second embodiment of a lock mechanism for the ladder, with a retracted position of the lock shown in phantom.

An alternate embodiment of a lock mechanism for the panel 22 is shown in FIGS. 10 and 11. A hook-like arm 86 is pivotally attached to a plate 88 by fastener 90. A cut-out space 87 (FIG. 10) between the arm 86 and the plate 88 provides space for the arm 86 to pivot about an axis passing through the fastener 90. A spring 89 is mounted in an aperture in the arm 86 so that the spring 89 is flexibly positioned between the arm 86 and the plate 88. The spring 89 biases arm 86 toward the position of the arm 86 shown in FIG. 10. The plate 88 is fastened to the transom 14 by bolts 91 so that arm 86 may extend through the aperture 80 in the panel 22. In this embodiment, the aperture 80 of panel 22 is formed with a contact plate 90 which is secured to the panel 22 by a fastener 92. When the panel 22 is being opened, a curved edge 93 of the arm 86 meets the contact plate 90. This causes arm 86 to pivot slightly about fastener 90 (against the force of the spring 89), allowing curved edge 93 to ride over the contact plate 90. When panel 22 is completely open, the contact plate 90 is forward of the curved edge 93. The spring 89 then causes arm 86 to pivot into its rest position (FIG. 10), whereby face 94 of arm 86 prevents the panel 22 from accidentally opening. Manually raising arm 86 against the force of the spring 89 and into the position illustrated by dashed line 96 releases the contact plate 90 from face 94. The panel 22 can then be moved into the position illustrated by dashed line 98 and subsequently closed.

Several features shown in the drawings are provided for convenience and improved operation. For example, the side bars 46 are provided at their free ends with caps 104 which prevent a person boarding the boat from being scratched by rough ends of the side bars 46. Also, each rung 44, 48 and 50 has a flat portion 106 (see FIG. 2) to provide better footing for persons using the ladder 26.

The relative positioning of the rungs 44, 48 and 50 and the joints 24, 52, 62 and 64 is important for proper loading distribution when the ladder is being used, and also for easy deployment and stowage of the ladder. A balance between even loading and compact, easy stowage and deployment is desirable, and is achieved in the preferred embodiment as illustrated. In the preferred embodiment as shown in FIG. 3, the top rung 44 is below and displaced from the hinge axis 24. A person standing on that rung and holding onto the hand rails 34 would exert a force on the ladder which would tend to close the panel 22. However, the location of the rung 44 is chosen so that force is not excessive and would be countered by the locking mechanism. Particularly, the hand rail 34 is spaced apart from the underside of the panel 22 (which affects the location of the rung 44) only by the amount necessary to provide adequate room to grip the hand rail. Moving the hand rail 34 any further away from the panel 22 only adds to the force about hinge 24 tending to close the panel 22, which would be undesirable.

Also, the joint 52 is just below the rung 44, and further down the pivot pins 62 are just above the next rung, 48. There are no rungs between the joint 52 and the pins 62. Thus, the weight of a person on rung 48 also tends to exert a force on the ladder which would tend to close the panel 22. Added to this force is the force created by use of the hand rails 34 which tends to close the panel 22. Nevertheless, the forces are minimized by the illustrated embodiment of the ladder, and the locking mechanism will maintain the panel 22 in the open position. The same would be true for a weight on the rung 50. Additionally, the plug 64 is positioned along the platform 16 relatively close to the aft end of the platform which tends to reduce the loads to which it is subjected, while providing the desired stowed and deployed positions for the lower ladder portion 30.

The lengths of the hand rails 34, the side bars 46 and the control links 32, and the location of joints 24, 52, 62 and 64, are all related. That is, changes in the length or position of any of these pieces may necessitate corresponding changes in some of the other pieces, so that the ladder 26 fully deploys and properly stows with the panel 22 closed. For example, if the joint 52 between the upper portion 28 and the lower portion 30 were to be made lower on the ladder 26, the length of the control link 32 would have to be adjusted to properly control the movement of the lower portion 30. In the embodiment illustrated in the drawings, the hand rail 34 is approximately 31¾" in overall length, the side bar 46 is approximately 25¼" i length, and the control link 32 is approximately 23¾" in length (with roughly a ¾" bend).

One important feature of the invention is that the hand rail 34 not only provide an important structural part of the ladder 26, but also provide an important functional advantage to a user. Unlike many prior art ladders, separate, fixed hand holds or rails are not needed with the present invention. That is because a portion of the ladder 26, i.e., the hand rails 34, extend above the level of the platform 16 when the ladder is deployed. When they are not needed, they stow neatly with the ladder 26.

The foregoing detailed description has been for the purpose of illustration. Thus, a number of modifications and changes may be made without departing from the spirit and scope of the present invention. For example, the number and spacing of the ladder rungs could be changed. Likewise, the ladder 26 could be used under a panel 22 other than with a swim platform 16. Therefore, the invention should not be limited by the specific embodiments described, but only by the claims.

What is claimed is:

1. A swim platform ladder for a boat, comprising:

a panel adapted to fit in an opening in a swim platform of a boat, said panel having a top side and an underside;

first hinge means for mounting the panel to the boat to pivot about a horizontal axis between a closed position in which the panel is generally horizontal and in the plane of the swim platform and an open position in which the panel is generally vertical and above the plane of the swim platform;

an upper ladder portion fixed to the underside of the panel so as to pivot about the first hinge means axis with the platform, said upper ladder portion having hand rails extending above the swim platform in the open position;

a lower ladder portion below the upper ladder portion in the open position, said lower ladder portion having at least one rung;

second hinge means for providing a joint between the upper ladder portion and the lower ladder portion for pivoting said portions relative to one another about a horizontal axis which is parallel to the first hinge means axis;

at least one control link having two ends;

third hinge means for pivotally connecting one end of each control link to the boat to rotate about a horizontal axis which is parallel to the first hinge means axis;

fourth hinge means for pivotally connecting the other end of each control link to the lower ladder portion for rotation about a horizontal axis which is parallel to the first hinge means axis;

locking means for securing the panel in the open position; and wherein moving the panel into the open position deploys the ladder to extend downwardly beneath the platform and moving the panel into the closed position folds the ladder to stow it, under the panel.

2. The ladder as in claim 1, wherein the fourth hinge means axis is below the second hinge means axis in the open position.

3. The ladder as in claim 1, wherein the third hinge means axis is in the plane of the swim platform and is aft of the first hinge means axis.

4. The ladder of claim 3, wherein the second hinge means axis is fore of the first hinge means axis in the closed position.

5. The ladder as in claim 1, wherein there is a control link on each of two sides of the ladder.

6. The ladder as in claim 1, wherein the fourth hinge means axis is above the rungs of the lower ladder portion in the open position.

7. The ladder as in claim 1, wherein the first hinge means axis is generally in the plane of the swim platform, the second hinge means axis is below the plane of the swim platform and aft of the first hinge means axis in the open position, the third hinge means axis is generally in the plane of the swim platform and aft of the second hinge means axis, and the fourth hinge means axis is below the second hinge means axis and fore of the fourth hinge means axis.

* * * * *